United States Patent [19]

Krüger et al.

[11] Patent Number: 4,606,304

[45] Date of Patent: Aug. 19, 1986

[54] ONE-PIECE ENGINE BLOCK

[75] Inventors: Hermann Krüger; Hermann Deutsch, both of Wolfsburg, Fed. Rep. of Germany

[73] Assignee: Volkswagenwerk AG, Wolfsburg, Fed. Rep. of Germany

[21] Appl. No.: 322,724

[22] Filed: Nov. 18, 1981

[30] Foreign Application Priority Data

Nov. 27, 1980 [DE] Fed. Rep. of Germany ..... 3044700
Jun. 13, 1981 [DE] Fed. Rep. of Germany ..... 3123527

[51] Int. Cl.[4] ..... F02F 1/02; F01M 9/10

[52] U.S. Cl. ..... 123/90.27; 123/90.34; 123/193 CH; 123/196 V

[58] Field of Search ..... 123/41.3, 41.57, 41.42, 123/41.48, 41.33, 90.33, 90.34, 193 H, 193 CH, 196 AB, 196 M, 196 V

[56] References Cited

U.S. PATENT DOCUMENTS 1,617,845 2/1927 Hall ..... 123/90.33
3,824,973 7/1974 Harhaus ..... 123/90.34
4,329,949 5/1982 Abts et al. ..... 123/196 V
4,343,270 8/1982 Kawabe ..... 123/196 V

FOREIGN PATENT DOCUMENTS 2739505 3/1979 Fed. Rep. of Germany ... 123/90.27
0544693 9/1922 France ..... 123/90.34

*Primary Examiner*—Craig R. Feinberg
*Attorney, Agent, or Firm*—Spencer & Frank

[57] ABSTRACT

An internal-combustion engine includes an engine block, a plurality of parallel cylinders and oil chambers defined in the engine block; intake valves, exhaust valves, overhead valve controls and crankshaft bearings supported in the engine block as well as a pump supported in the engine block for delivering oil through the oil chambers for cooling the engine. The engine block is a single-piece cast component in which the oil chambers extend adjacent and parallel to the cylinders and are accessible from opposite sides of the engine block where the crankshaft bearings and the valve controls are supported.

11 Claims, 3 Drawing Figures

ONE-PIECE ENGINE BLOCK

BACKGROUND OF THE INVENTION

This invention relates to a reciprocating piston-type internal-combustion engine having parallel-arranged cylinders and oil chambers for cooling the oil circulating in the engine.

An internal-combustion engine of the above-outlined type is disclosed in German Offenlegungsschrift (Laid-Open Application) No. 2,609,844 wherein in an air-cooled internal-combustion engine in the hot regions of the cylinder heads at least one channel is provided in which the lubricating oil, functioning there as cooling oil, is conveyed by an oil pump. This measure takes into consideration the fact that in air-cooled internal-combustion engines, which in principle offer the advantage of a simple construction, there may occur high temperatures at least at certain locations.

SUMMARY OF THE INVENTION

It is an object of the invention to provide an improved reciprocating piston-type internal-combustion engine which is cooled at least predominantly by oil so that genuine fluid cooling is provided without the necessity of partitions and seals required for water cooling and which permits manufacture of the engine housing in one cast piece, for example, by means of reusable cores.

This object and others to become apparent as the specification progresses, are accomplished by the invention, according to which, briefly stated, the internal-combustion engine has a one-piece cast engine block which accommodates the engine cylinders, bearings for the crankshaft and overhead valve control and has, adjacent the cylinders, oil chambers which extend parallel to the cylinders and which are accessible from the side of the crankshaft and the valve control. The engine block further has at least one oil channel at the height of the valve control.

The invention makes it possible to manufacture the engine block in one piece from the crankshaft bearing up to the valve control by means of pressure casting or other casting method, to obtain, for example, a gray-cast engine block. The oil chambers extend in such a manner that a heat transfer takes place from the cylinder walls to the oil and from the oil to the ambient air by means of the exterior walls of the engine block. In order to increase the heat dissipation to the ambient air, conventional means, such as cooling fins, may be provided, which can be manufactured in one process step together with the shaping of the engine block.

DESCRIPTION OF THE PREFERRED EMBODIMENT

Figure 1:
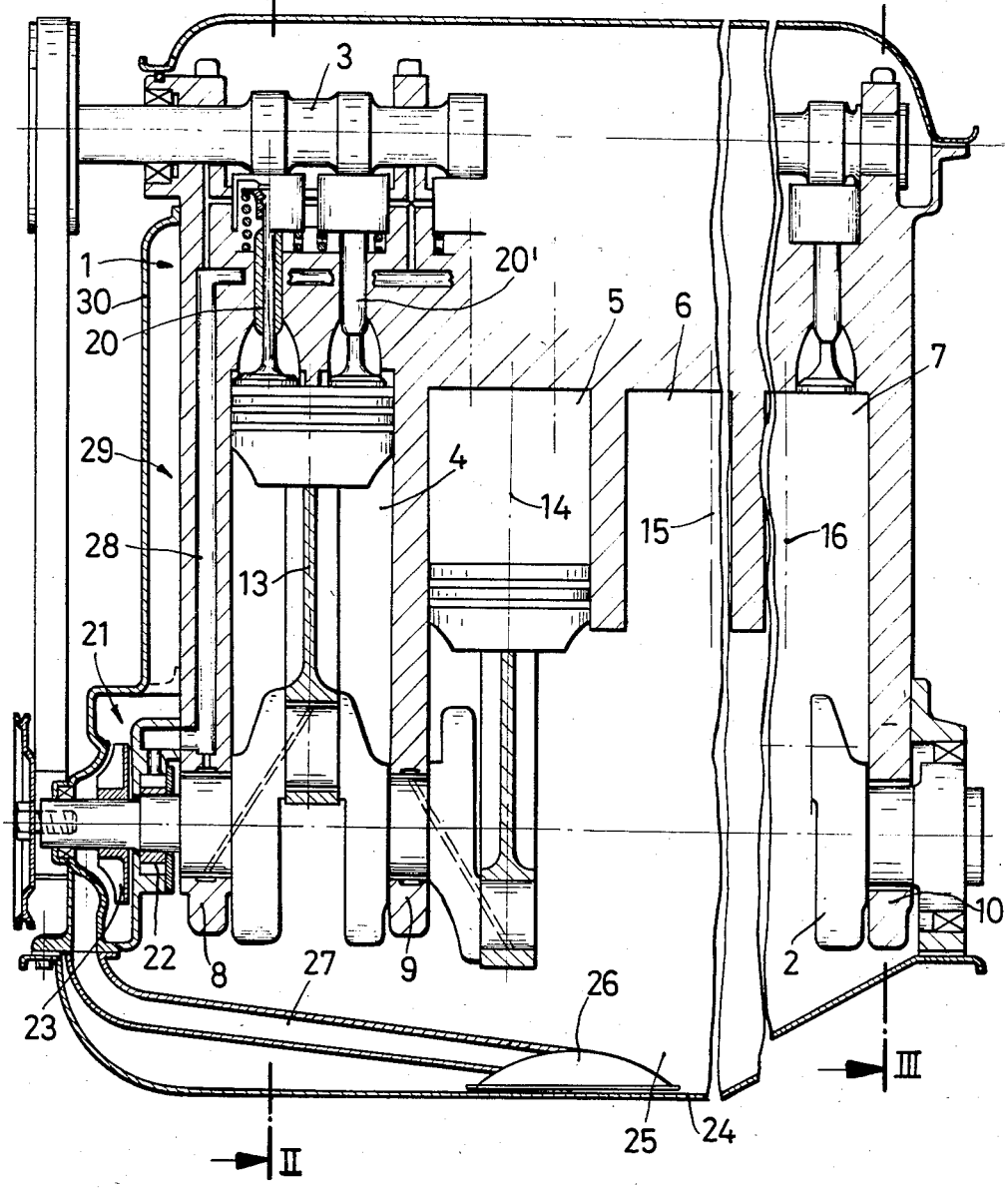
FIG. 1 is a side elevational sectional view of an in-line four-cylinder internal-combustion engine.
Figure 2:
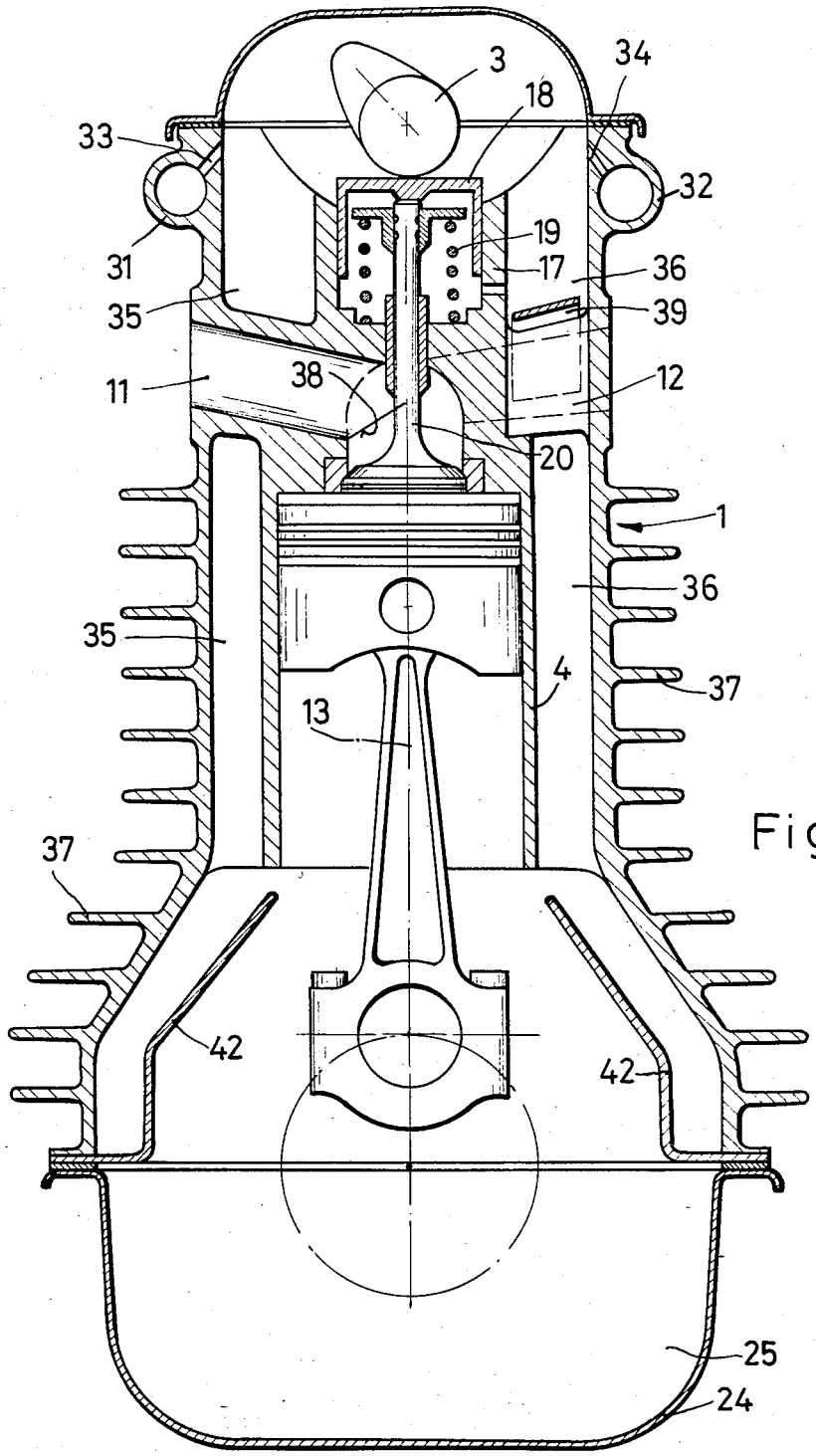
FIG. 2 is a sectional view taken along line II—II of FIG. 1.

Turning to FIGS. 1 and 2, the internal-combustion engine shown therein has a one-piece cast engine block 1 which extends between the center of the bearing of the crankshaft 2 and the center of the bearing of the camshaft 3 and accommodates the cylinders 4, 5, 6 and 7. On the side facing away from the crankshaft bearings 8, 9 and 10 with respect to the intake and exhaust channels 11 and 12, that is, at the top, the engine block 1 is provided with projections oriented parallel to the mutually parallel axes 13, 14, 15 and 16 of the cylinders. Only the projection 17 above the cylinder 4 is shown in FIG. 2. The projections serve to accommodate valve driving (control) elements such as bucket tappets 18 and valve springs 19. The axes of the valves themselves extend parallel to the cylinder axes. It is noted that FIG. 1 shows only the intake valve 20 and the exhaust valve 20' associated with the cylinder 4.

Referring particularly to FIG. 1, an oil pump unit 21 which is composed of two individual pumps 22 and 23 driven by the crankshaft 2, delivers lubricating and cooling oil from the oil reservoir 25 formed by the oil sump 24 through a usual oil filter 26 and a conduit 27 into two oil circuits, such as a lubricating oil circuit 28 in which the lubricant is under relatively high pressure, and a cooling oil circuit 29 in which a larger quantity of oil circulates at a lower pressure. In the region of the pump unit 21 the cooling oil channels of the cooling circuit 29 are formed by flanged-on vane-like members 30.

With particular reference to FIG. 2, oil supply channels 31 and 32 are provided at the exterior of the engine block 1 as part of the cooling oil circuit 29 and are communicating with respective nozzle-like openings 33 and 34 which open into the oil chambers 35 and 36 at both sides of the cylinders. At the pressure generated by the oil pump 23, cooling oil is thus sprayed in the direction of the camshaft 3 and the other parts of the valve control. The oil then flows down along the walls of the oil channels 35 and 36, thus absorbing heat from the interior of the engine block and dissipating the heat to the ambient air through the exterior wall of the engine block. To enhance this heat transfer, cooling fins 37 are provided which, if the internal-combustion engine functions as the power plant in a motor vehicle, are exposed to the draft generated by driving or may be covered so as to form air channels which are in communication with a fan.

From the point of view of making the engine block as a one-piece cast component while utilizing reusable cores, it is of importance that the oil chambers 35 and 36 extend parallel to the cylinder axes and have no undercut portions which would prevent removal of the cores toward the top (for the parts of the oil chambers 35 and 36 extending to the center plane of the intake and exhaust channels 11 and 12) or toward the bottom (for the lower portions of the oil chambers 35 and 36). The term undercut is intended to mean any change in diameter transversely to the pulling direction of the reusable cores, which thus prevents their removal (thus, even a gradual reduction in diameter). Therefore, if there is a change in the cross-sectional dimensions of the oil chambers, such change should be an increase in the direction of removal of the reusable cores. Thus, the walls of the oil chambers should be sloped a few degrees in the sense of enlarging the cross-sectional dimension of the oil chambers in the direction of removal of the reusable cores.

The intake channel 11 and the exhaust channel 12 are so designed that two partial cores may be used for their manufacture; the parting plane between the two partial cores is designated at 38 in FIG. 2. Accordingly, the one partial core is pulled out obliquely outwardly, while the other partial core is pulled out downwardly in the direction parallel to the associated cylinder axis 13. In this case too, undercut portions which could prevent these core movements must be avoided.

As described above, the cooling oil flows through the oil chambers 35 and 36 from above downwardly and also impinges on the intake channel 11 and exhaust channel 12. Since the exhaust channels may become very hot, measures may have to be taken to reduce the influx of heat into the oil at those locations. This purpose is served by a shield 39; other means, known by themselves, are port liners in the outlet channels or internal and/or external outlet coatings on the exhaust channels. It may also be of advantage to provide insulation at the piston bottom, as is also known in the art.

Figure 3:
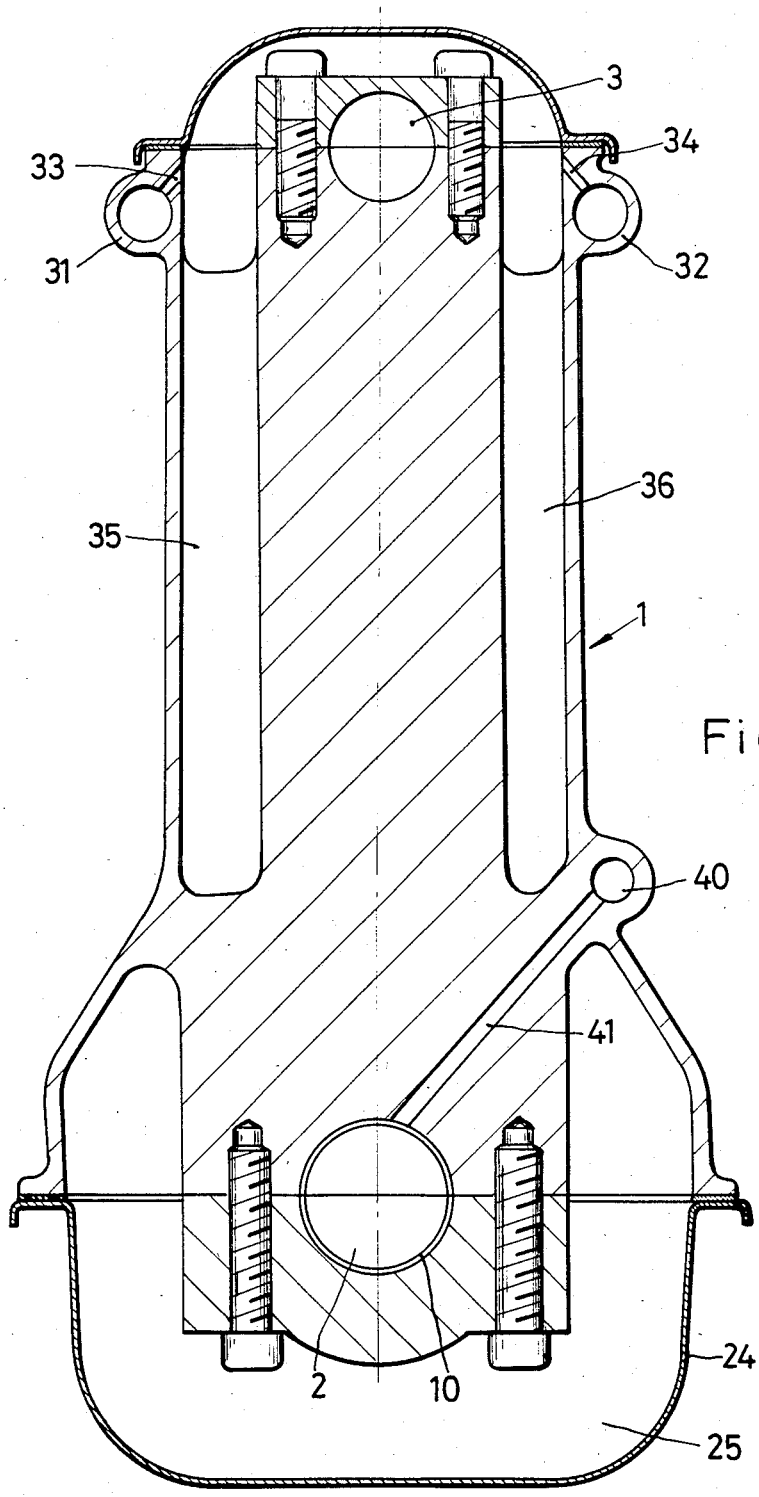
FIG. 3 is a sectional view taken along line III—III of FIG. 1.

The oil supply channels 31 and 32 are thus disposed outside of the path of removal of the reusable cores. As shown in FIG. 3, lubricating oil channels 40 for supplying the crankshaft bearings (such as the crankshaft bearing 10) may also be provided close to the exterior of the engine block. The channels 40 are connected with the regions to be lubricated by means of channels 41 provided in the engine block 1.

Oil guide plates 42 are provided to maintain the hot oil in contact with the cooled regions of the engine block 1.

Thus, the present invention utilizes the basic advantage of an exclusively oil cooling compared to water cooling, namely the elimination of the separation of oil and water circuits, to realize an engine design which is particularly simple to manufacture.

The internal-combustion engine according to the invention is not limited to a structure with vertically oriented cylinder axes. It is feasible to install the engine in a horizontal or oblique position since the resulting influence on the oil flow in the oil chambers can be reversed by corresponding increases or reductions in cross section, particularly in the region of the intake and exhaust channels.

It will be understood that the above description of the present invention is susceptible to various modifications, changes and adaptations, and the same are intended to be comprehended within the meaning and range of equivalents of the appended claims.

What is claimed is:

1. An internal combustion engine comprising a single-piece cast engine block; a plurality of parallel cylinders and cooling chambers defined in the single-piece cast engine block; said cooling chambers extending adjacent and parallel to said cylinders and using solely oil as a liquid coolant; intake valves, exhaust valves, overhead valve control means and crankshaft bearings supported in said one-piece cast engine block; said cooling chambers being accessible from opposite sides of said one-piece cast engine block where said crankshaft bearings and said valve control means are supported; said one-piece cast engine block further defining at least one oil port arranged at a height level of said valve control means.

2. An internal-combustion engine as defined in claim 1, wherein said valve control means includes a camshaft and camshaft bearings supported in said engine; said engine block extending from the middle of said crankshaft bearings to the middle of said camshaft bearings.

3. An internal-combustion engine as defined in claim 1 further comprising cooling ribs forming part of the engine block and being arranged in a zone of said oil chambers.

4. An internal-combustion engine as defined in claim 1, wherein said engine block further defines intake and exhaust channels communicating with respective cylinders; said intake and exhaust channels being void of undercut portions as viewed from sides of the engine block and from the respective cylinders for permitting removal therefrom of reusable cores upon conclusion of casting of the engine block.

5. An internal-combustion engine as defined in claim 1, wherein said engine block further defines intake and exhaust channels communicating with respective cylinders; further comprising projections forming part of the engine block; said projections being situated above respective said cylinders on a side of said engine block remote from said intake and exhaust channels; each said projection defining a space accommodating part of said valve control means; said valves and said cylinders having parallel axes; said projections extending parallel to the axes of said cylinders and said valves.

6. An internal-combustion engine as defined in claim 1, wherein said engine block further defines intake and exhaust channels communicating with respective cylinders; said oil chambers having cross-sectional changes in a zone of said intake and exhaust channels for affecting an oil flow therein.

7. An internal-combustion engine as defined in claim 1, further comprising means situated in said oil chambers at predetermined hot locations of said oil chambers for reducing heat transfer to oil in said oil chambers.

8. An internal-combustion engine as defined in claim 1, wherein each said oil chamber has opposite first and second ends situated, respectively, at said opposite sides of said engine block; each said oil chamber extending parallel to said cylinders from said first end to said second end.

9. An internal-combustion engine as defined in claim 1, wherein said oil chambers are void of undercut portions as viewed from said opposite sides of the engine block for permitting removal therefrom of reusable cores upon conclusion of casting of the engine block.

10. An internal-combusiton engine as defined in claim 9, wherein said engine block further defines oil delivering channels extending at a height level of said valve control means at a location externally of a path of removal of the reusable cores; and oil ports connecting said oil delivering channels with said oil chambers.

11. An internal-combustion engine as defined in claim 10, further comprising an oil reservoir attached to said engine block; said oil chambers being in communication with said oil reservoir, whereby oil may flow from said oil ports through said oil chambers into said reservoir.

* * * * *